United States Patent [19]

Nishikawa

[11] Patent Number: 4,657,238

[45] Date of Patent: Apr. 14, 1987

[54] SHEET TURN OVER APPARATUS

[75] Inventor: Masaji Nishikawa, Hachioji, Japan

[73] Assignee: Olympus Optical Co., Ltd., Tokyo, Japan

[21] Appl. No.: 707,953

[22] Filed: Mar. 4, 1985

[30] Foreign Application Priority Data

Mar. 6, 1984 [JP] Japan ..... 59-41382
Mar. 29, 1984 [JP] Japan ..... 59-59526

[51] Int. Cl.[4] ..... B65H 39/00

[52] U.S. Cl. ..... 271/186; 271/65; 271/225; 271/402

[58] Field of Search ..... 271/186, 184, 185, 902, 271/225, 65; 355/35 H, 145 H

[56] References Cited

U.S. PATENT DOCUMENTS 4,078,789 3/1978 Kittredge et al. ..... 271/902 X
4,220,323 9/1980 Smith ..... 271/65
4,385,825 5/1983 Kaneko ..... 271/65 X

FOREIGN PATENT DOCUMENTS 0050943 8/1977 Japan .
0036851 3/1983 Japan ..... 271/65

*Primary Examiner*—Andres Kashnikow
*Assistant Examiner*—M. C. Graham
*Attorney, Agent, or Firm*—Fleit, Jacobson, Cohn & Price

[57] ABSTRACT

An apparatus for turning over copies supplied from a copying machine including first and second rollers arranged vertically to form a first nip portion through which copies are successively fed horizontally. A third roller is arranged beside the second roller to form a second nip portion therebetween, and a fourth roller is arranged beneath the third roller to form a third nip portion therebetween. A first sheet guide is provided which can be selectively projected into a copy feed path supplied from the first nip portion to divert the copy onto an inclined surface of a sheet guide member. An arcuate second sheet guide member is arranged between the second and third rollers in such a manner that a sheet fed from the first nip portion and diverted by the first sheet guide member into the sheet support member is fed from the second nip portion into the third nip portion. A control circuit is provided for driving selectively the first sheet guide member in such a manner that only the first copy among a plurality of copies is not turned over, but the remaining copies are all turned over.

13 Claims, 15 Drawing Figures

SHEET TURN OVER APPARATUS

BACKGROUND OF THE INVENTION

The present invention relates to an apparatus for turning over a sheet on which an image is formed by means of am image forming apparatus, such as a duplicating machine and a printer, and also relates to a sheet orientation apparatus for piling successive sheets in a desired order.

In an image forming apparatus such as an electrophotographic copying machine, there is sometimes provided a sheet turn-over apparatus in order to form images on both sides of a sheet or pile successive sheets in a correct order.

In order to attain the former function, after an image has been formed on one side of a sheet and the sheet has been turned over, at a suitable timing the sheet is supplied again into a toner image transfer position. Therefore, the apparatus is liable to be large is size and complicated in construction. In the latter application, since the apparatus is sufficient to have the function of merely turning over a sheet, a rather simple and small apparatus has been proposed. But there are only few practical apparatuses. For instance, in Japanese patent application Laid-open Publication No. 50,943/74, there is disclosed a sheet turn over apparatus in which a sheet moving horizontally is fed upwardly and then the rear edge is clamped between feed rollers and the sheet is fed horizontally. In this known apparatus, since the sheet is fed completely in an upright manner, the sheet is liable to be bent and thus the turn over might not be effected correctly. Particularly, when the sheet is thin, it might be jammed.

In Japanese patent application Laid-open Publication No. 97,744/77 there is further proposed a sheet turn over apparatus in which a horizontally moving sheet is fed upwardly along an inclined sheet guide and then the sheet is fed horizontally in a reverse direction.

FIG. 1 is a cross section illustrating the known sheet turn over apparatus disclosed in Japanese patent application Laid-open Publication No. 97,744/77. The reference numeral 1 denotes a main body, 2 and 3 first and second rollers for feeding a sheet horizontally, 4 guide plates for guiding the sheet into a nip portion between the first and second rollers 2 and 3, a sheet support plate 5 for receiving a sheet 6 fed out of the main body 1 on its inclined surface, and the reference numeral 7 represents a sheet stop member which is rotatably journaled about a shaft 8 and can take, selectively, a first position shown in the drawing and a second position shifted by 90° with respect to the first position viewed in the counterclockwise direction. Reference numerals 9 and 10 denote third and fourth rollers, arranged vertically underneath the second roller 3. The reference numeral 11 represents a guide plate for reversing the sheet substantially through 180°, and reference numeral 12 denotes a sheet discharged on a sheet tray 13.

When the sheet stop member 7 is in the first position shown in FIG. 1, after the sheet 6 has been completely fed leftward along the sheet support plate 5 by means of the first and second rollers 2 and 3, the rear edge of sheet 6 falls down due to the gravitational force and is clamped into a nip portion between the second and third rollers 3 and 9 as illustrated in FIG. 1. Then the sheet 6 is fed by the second and third rollers 3 and 9 and passes along the guide plate 11. After that the sheet is fed into the nip portion between the third and fourth rollers 9 and 10 and is fed horizontally leftward. In this manner, the sheet is turned over and is discharged onto the sheet tray 13.

On the other hand, when the sheet stop member 7 is in the second position, after a sheet has been clamped and fed between the first and second rollers 2 and 3 onto the sheet support member 5, it is prevented by the sheet stop member 7 from falling down into the nip portion between the second and third rollers 3 and 9. In this manner successive sheets are discharged on the sheet support member 5 which now serves as a sheet tray.

FIG. 2 is a front view showing the outer appearance of a known copying machine the desk top type. A reference numeral 14 denotes a main body, 15 and 16 denote discharging rollers and a reference numeral 17 represents a sheet tray. Usually the discharging rollers 15 and 16 are arranged near the bottom of main body 14 and the sheet tray 17 is arranged horizontally or substantially horizontally so as to receive stably a sheet fed out of the main body 14 by means of the discharging rollers 15 and 16. In FIG. 2, reference numeral 18 denotes a sheet supply tray. In the case of applying the known sheet turn over apparatus shown in FIG. 1 to the copying machine illustrated in FIG. 2, the following disadvantages will be encountered.

In the apparatus illustrated in FIG. 1, the third and fourth rollers 9 and 10 which function to turn over the sheet are aligned vertically with respect to the first and second rollers 2 and 3, and thus there is required a relatively large space below the rollers 2 and 3. Thus the whole apparatus is liable to be large. Further, since the traveling direction of the sheet has to be changed substantially over 180° along the third roller 9 by means of the guide member 11, it is necessary to make the diameter of the third roller 9 sufficiently large, otherwise the sheet would not be curved smoothly and might be jammed frequently.

Moreover, in the case of providing the ability for selecting a first mode in which a sheet is discharged without being turned over and a second mode in which a sheet is turned over, in the known apparatus shown in FIG. 1, it is impossible to discharge sheets on the same tray. Further, in the first mode, since the sheet support member 5 serving as the sheet tray is inclined by a very large angle, a number of sheets could not be supported stably and further it is rather difficult to take out a stack of sheets. Moreover, in the case of applying the sheet turn over apparatus shown in FIG. 1 to a copying apparatus in which a toner image is fixed onto a sheet by heating it, since a sheet discharged onto the inclined sheet support member 5 is still hot or at least warm, when a sheet, particularly a thin sheet, is bent or curved, the sheet is permanently deformed after being cooled.

Further, in the case of adopting the known sheet turn over apparatus shown in FIG. 1 to the general copying machine illustrated in FIG. 2 as an optional apparatus, it is necessary to arrange the sheet turning over rollers 9 and 10 immediately below the sheet discharging rollers 2 and 3 arranged in the main body 1, and therefore, there results a problem that construction and handling of a detaching mechanism might be complicated.

In an image forming apparatus such as a duplicating machine and a printer, an image record sheet is discharged on a tray while a recorded surface is faces upward, and the next sheet is piled on the last sheet. Therefore, if a plurality of originals arranged in a normal order of pages are duplicated, recorded sheets are stacked on the tray in a reversed order of pages.

In Japanese patent application Laid-open Publication No. 37,433/77, there is proposed a collating apparatus in which successive recorded sheets are turned over and then are discharged on the tray. However, in such a known apparatus, since the turned over sheets are always discharged on the tray, a user could not confirm the condition of images recorded on the sheets. Such a drawback also occurs in case of using the sheet turn over apparatus disclosed in the above mentioned Japanese patent application Laid-open Publication No. 97,744/77.

Further, known collating apparatuses which have been used in practice have in addition to the collating function a so-called sorting function in which a plurality of sets of successive sheets are discharged on separate trays. However such apparatuses are very complicated in construction and quite large in size.

SUMMARY OF THE INVENTION

The present invention has for an object to provide a sheet turn over apparatus which can obviate various drawbacks of the known apparatus and can be handled easily, and in which sheets can be fed stably.

It is another object of the invention to provide a sheet turn over apparatus which can be advantageously applied to various kinds of image forming apparatuses as an optional apparatus.

According to the invention, a sheet turn over apparatus comprises

- first and second rollers arranged vertically to form a first nip portion therebetween for feeding a sheet substantially horizontally;
- a third roller arranged substantially laterally with respect to the second roller to form a second nip portion between the second and third rollers;
- a fourth roller arranged below the third roller to form a third nip portion between the third and fourth rollers;
- a sheet support member having an opening arranged above the third roller and an inclined surface for supporting a sheet fed through the opening;
- a first sheet guide member arranged in such a position that the first sheet guide member is engaged with a sheet fed substantially horizontally from the first nip portion and the sheet is guided through the opening onto the inclined surface of the sheet support member; and
- a second sheet guide member arranged between the second and third nip portions in such a manner that a sheet fed from the sheet support member through the second nip portion is guided into the third nip portion.

In the sheet turn over apparatus according to the invention, the first and second rollers are arranged vertically, while the third roller is arranged laterally with respect to the second roller. Therefore, the necessary space underneath the second roller can be made much smaller than the known apparatus. Further, a sheet fed through the nip portion between the second and third rollers is guided into the nip portion between the third and fourth rollers, which are arranged vertically, and is fed horizontally therethrough. Therefore, it is sufficient to turn the sheet over about 90° which is substantially half of the known turn over angle. This results in that the possibility that a sheet is jammed between the second sheet guide member and the third roller is very small as compared with the known apparatus.

In preferred embodiments of the sheet turn over apparatus according to the invention, it is very easy to construct the apparatus to have the ability for selecting a sheet turn over mode and a sheet non-turn over mode. In both the modes of operation, sheets are discharged onto the same tray arranged substantially horizontally. Therefore, stacks of sheets can be taken out very easily. It should be noted that since all sheets are supported horizontally on the tray, even thin sheets are hardly deformed or curved. Further, several components of the apparatus according to the invention are constructed into an optional device, and the optional device is applied to an imaging device comprising components which function like the remaining components of the apparatus according to the invention to construct the sheet turn over apparatus.

The present invention also relates to a sheet orientation apparatus in which a number of sheets can be collated or sorted on the same tray, while the condition of the images formed on sheets can be confirmed easily.

According to the invention, the sheet orientation apparatus comprises

- a sheet turn over switching mechanism for discharging a sheet selectively in a non-turn over mode and in a turn over mode;
- a sheet discharging mechanism for discharging successive sheets on a tray to form a stack of sheets; and
- control means for driving said sheet turn over switching mechanism in such a manner that only a first sheet among a series of sheets is discharged on the tray while an image recorded surface of the first sheet faces in the opposite direction to that of the remaining sheets.

In the case of forming a number of sheets, a first sheet is discharged on a tray while its record surface faces upward, and the remaining sheets are turned over and discharged on the tray. Then, the condition of the image can be simply confirmed by the first sheet, and also the successive sheets are stacked in the normal order. Therefore, by turning over only the first sheet manually after the completion of the formation of all the sheets, all the sheets are collated correctly. Further, in the case of forming a plurality of sets of sheets, in each set a first copy is discharged on the tray without being turned over, whereas the remaining copies are turned over. Then, a plurality of the sets can be easily separated from each other at non-turned over sheets, and further the condition of the images formed on the sheets can be simply confirmed by the first sheets in each set.

Moreover, when the sheet orientation apparatus according to the invention is applied to an image forming apparatus with an automatic document feeder, the operation modes of the sheet orientation apparatus can be controlled in conjunction with the operation of the automatic document feeder. Then, a plurality of sets of sheets which can be separated easily are obtained on the tray by simply setting a stack of originals in the automatic document feeder.

The above operation may be equally attained in the case of applying the sheet orientation apparatus according to the invention to a printer in which image information is supplied in the form of an electric signal.

DESCRIPTION OF THE PREFERRED EMBODIMENTS

Figure 3:
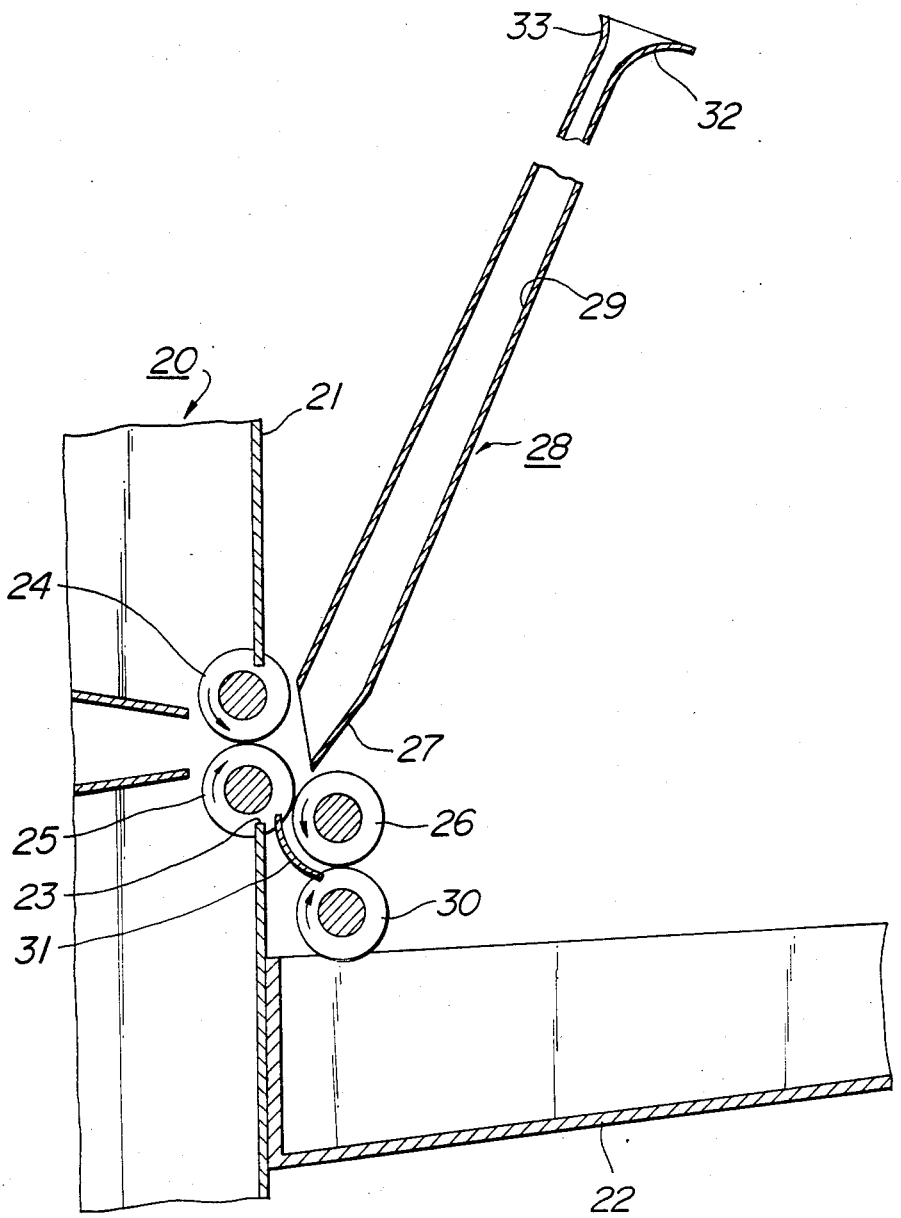
FIG. 3 is a cross section depicting an embodiment of the sheet turn over apparatus according to the invention.

FIG. 3 is a cross sectional view showing an embodiment of the sheet turn over apparatus according to the invention. In FIG. 3, reference numeral 20 denotes an image forming apparatus to which the sheet turn over apparatus according to the invention is applied. The image forming apparatus comprises a side cover 21 in which is formed an opening 23 for discharging a sheet having an image recorded by the image forming apparatus. The sheet is to be discharged onto a sheet tray 22 while a recorded surface faces downward. In the image forming apparatus 20, there are provided first and second rollers 24 and 25 which serve to discharge the sheet horizontally out of the apparatus 20. Outside the side cover 21 is arranged a third roller 26 in such a manner that the nip portion between the second and third rollers 25 and 26 is situated not vertically, but laterally with respect to the nip portion between the first and second rollers 24 and 25. Above the third roller 26 is arranged a first sheet guide 27 in such a manner that the first sheet guide 27 extends into the feed path of a sheet discharged by the first and second rollers 24 and 25. There is further provided a sheet support member 28 which is so inclined that the sheet discharged from the first and second rollers 24 and 25 and diverted by the first sheet guide member 27 is fed along an inclined surface 29 of the sheet support member 28 until the rear edge of the sheet is discharged out of the nip portion between the first and second rollers 24 and 25. Immediately below the third roller 26 is arranged a fourth roller 30 in such a manner that the nip portion between the third and fourth rollers 26 and 30 is shifted around the third roller 26 by about 90° with respect to the nip portion between the second and third rollers 25 and 26. There is further arranged a second sheet guide member 31 which is curved along the third roller 26 from the nip portion between the second and third rollers 25 and 26 to the nip portion between the third and fourth rollers 26 and 30. The second sheet guide 31 serves to guide the sheet fed by the second and third rollers 25 and 26 substantially downwardly into the nip portion between the third and fourth rollers 26 and 30. Then, the sheet is fed substantially horizontally by means of the rollers 26 and 30 and is discharged onto the sheet tray 22 which is arranged substantially horizontally.

In the sheet turn over apparatus shown in FIG. 3, a sheet having an image recorded on its upper surface is clamped into the nip portion between the first and second rollers 24 and 25 and is fed substantially horizontally. The sheet thus discharged out of the image forming apparatus 20 is diverted upward by means of the inclined surface of the first sheet guide member 27 and is fed along the inclined surface 29 of the sheet support member 28. In this manner, the discharged sheet is temporarily held in the sheet support member 28. When the rear edge of the relevant sheet has passed through the nip portion between the first and second rollers 24 and 25, the sheet is released from the feeding force due to the first and second rollers and the rear edge of paper descends into the nip portion between the second and third rollers 25 and 26 along the second roller 25 and is clamped therein. Then the sheet is fed in a reverse direction substantially vertically and is turned substantially by 90° by means of the second sheet guide member 31. Then the sheet is clamped in the nip portion between the third and fourth rollers 26 and 30 and is discharged horizontally onto the tray 22, while its recorded surface faces downward. In this manner, the sheet is turned over and then is discharged on the sheet tray 22 substantially horizontally.

It has been experimentally confirmed that it is preferable to provide the sheet support member 28 on the side plate 21 of the image forming apparatus 20 in such a manner that the sheet support member 28 makes an angle of about 30° with respect to a vertical line. By such a construction, even a thin sheet is hardly bent or curved and further the sheet can be positively moved downward due to the gravitational force. Further, it is preferable to make the angle between the nip portion between the second and third rollers 25 and 26 and the nip portion between the third and fourth rollers 26 and 30 as small as possible. But due to a limitation from the view point of construction, said angle is preferably selected within a range of 90° to 120°.

Figure 1:
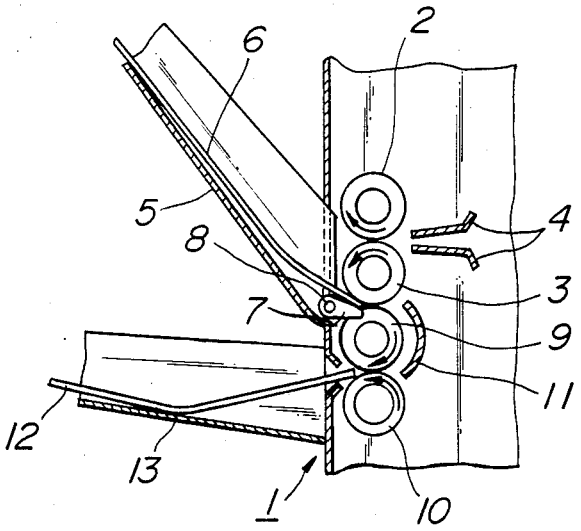
FIG. 1 PRIOR ART
FIG. 1 is a cross sectional view showing a construction of a known sheet turn over apparatus.
Figure 2:
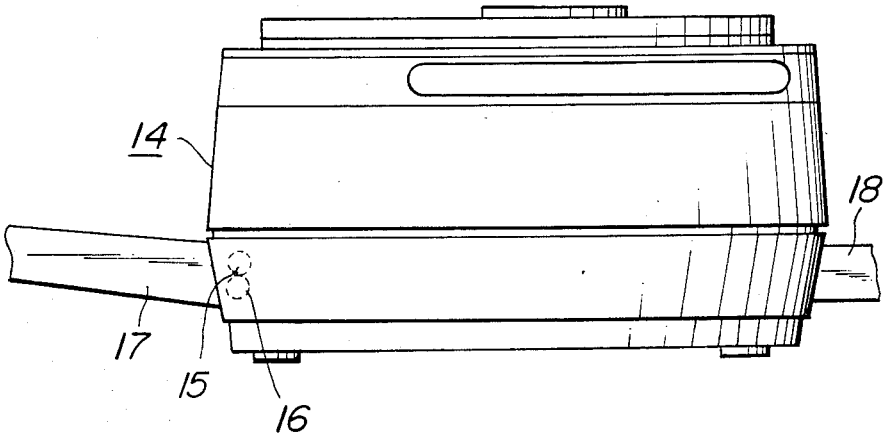
FIG. 2 PRIOR ART
FIG. 2 is a first view illustrating the outer appearance of a duplicating machine of the desk top type.

In the case of applying the sheet turn over apparatus according to the present invention to a copying machine of the desk top type shown in FIG. 2, a sheet might be longer than the distance from the nip portion between the first and second rollers to a document table. In such a case, it is undesired to form the sheet support member 28 in such a manner that it might protrude over the document table. In the present embodiment the upper end of the sheet support member 28 is opened. Then, the sheet support member 28 does not extend beyond the document table, and further, a sheet which is longer than the sheet support member 28 can be supported without difficulty.

That is to say, as illustrated in FIG. 3, an opened end 32 continuous with the inclined surface 29 and an opened end 33 continuous with a surface opposite to the inclined surface 29 are tapered outwardly so that the longer sheet is fed along the tapered end 32 to extend beyond the sheet support member 28.

When the sheet turn over apparatus shown in FIG. 3 is applied to a copying machine comprising a reciprocating document table, it is preferable to arrange a cover above the opened end of the sheet support member so that the air movement which is generated by the moving document table will not directly affect a sheet that extends out of the sheet support member.

Figure 4:
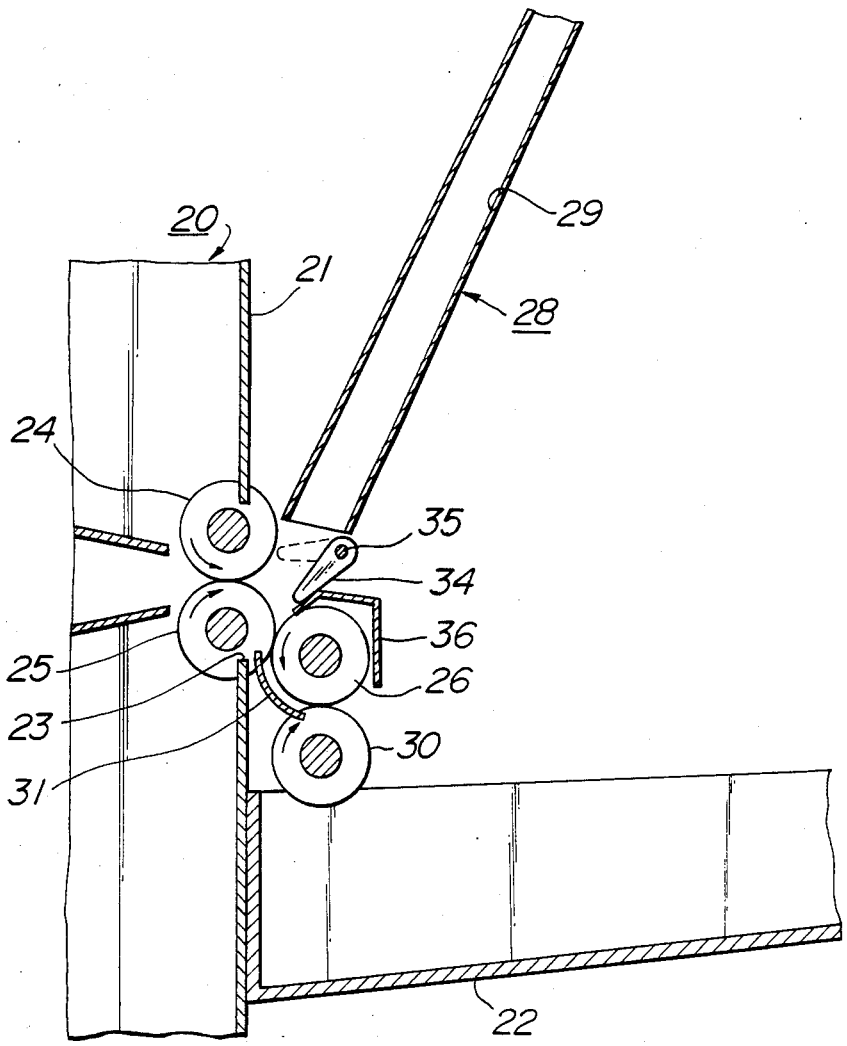
FIG. 4 is a cross sectional view showing another embodiment of the sheet turn over apparatus according to the invention.

FIG. 4 is a diagram illustrating another embodiment of the sheet turn over apparatus according to the invention in which the first sheet guide member 27 shown in FIG. 3 is constructed movably, and a sheet discharged from the apparatus horizontally is selectively fed either in the sheet support member 28 or directly onto the tray 22 horizontally. In the present embodiment, the first sheet guide is formed by a lever 34 which extends perpendicularly to the plane of the drawing and is journaled about a shaft 35. The first sheet guide 34 can be selectively indexed into a first position shown by a solid line in which a sheet discharged horizontally by first and second rollers 24 and 25 is diverted into a sheet support member 28, and into a second position shown by a broken line in which the first sheet guide member 34 does not interact with the horizontally fed sheet.

The first guide member 34 is fixed to the shaft 35 and the shaft is rotated between the first and second positions by means of a suitable mode selection means, not shown.

There is further provided a third sheet guide member 26 above a third roller 26, which is so constructed that when the first sheet guide member 34 is in the second position, the sheet is effectively discharged onto the tray 22 without contacting the third roller 26. The remaining construction of the present embodiment is similar to that of the previous embodiment shown in FIG. 3 and thus a detailed explanation is omitted.

In the present embodiment, when the movable first sheet guide member 34 is in the first position, a sheet discharged horizontally by means of the first and second rollers 24 and 25 is diverted by the first sheet guide member 34 into the sheet support member 28 along its inclined surface 29. After the sheet has been completely discharged by the rollers 24 and 25, the rear edge of the sheet falls down into the nip portion between the second and third rollers 25 and 26 and the sheet is diverted substantially by 90° by means of the second sheet guide member 31 into the nip portion of the third and fourth rollers 26 and 30. Finally, the sheet is discharged horizontally onto the tray 22 while the record surface faces downward. In this manner, when the first sheet guide member 34 is in the first position, the sheet is turned over. This mode of operation is called a turn over mode.

Contrary to this, when a non-turn over mode is selected, the first sheet guide member 34 is rotated into the second position. Then, the sheet fed by the first and second rollers 24 and 25 is not diverted by the first sheet guide member 34, but is discharged horizontally along the third sheet guide member 36 onto the tray 22.

In the present embodiment, the turn over mode and the non-turn over mode can be selected easily, and in both the operational modes the sheets are discharged onto the same tray 22. Therefore, a stack of sheets can be easily taken out of the tray 22. It should be noted that since the sheets are always stacked on the substantially horizontally arranged tray 22, the sheets are hardly bent or curved even if hot or warm and thin sheets are discharged.

Figure 5:
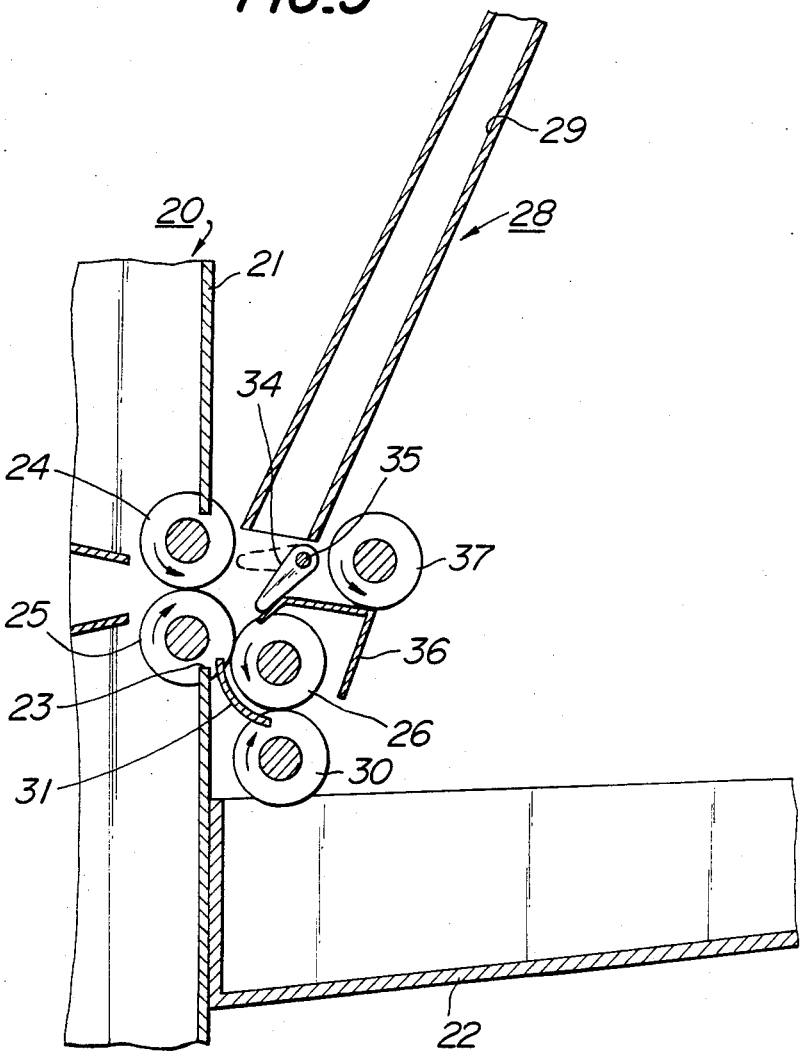
FIG. 5 is a cross sectional view illustrating a modification of the embodiment shown in FIG. 4.

FIG. 5 is a cross sectional view showing a modification of the embodiment illustrated in FIG. 4. In the present modified embodiment, in order to align sheets much more correctly on the tray 22 in the non-turn over mode, there is provided a resilient roller 37 which is in contact with the upper surface of the third sheet guide member 36. In the non-turn over mode, a sheet which is discharged horizontally by the first and second rollers 24 and 25 is clamped between the resilient roller 37 and the third sheet guide member 36 and is positively fed onto the tray 22.

The resilient roller 37 is made of such material and in such a shape that an extremely large rotational load is not produced when no sheet exists between the resilient roller 37 and third sheet guide member 36. Preferably, the resilient roller may be formed by a formed elastomer, such as rubber and plastics, or may be formed by a thin ring made of elastomer. The operation of the apparatus of the present embodiment in the turn over mode is the same as that of the apparatus illustrated in FIG. 4, and thus its explanation is omitted.

In the present embodiment, even a thin sheet can be positively and stably discharged onto the tray in the non-turn over mode, and therefore successive sheets are correctly stacked on the tray.

The sheet turn over apparatus according to the invention is preferably applied as an optional device to an image forming apparatus in which a sheet is discharged substantially horizontally from a side plate of the image forming apparatus in order to provide the sheet turn over function.

Figure 6:
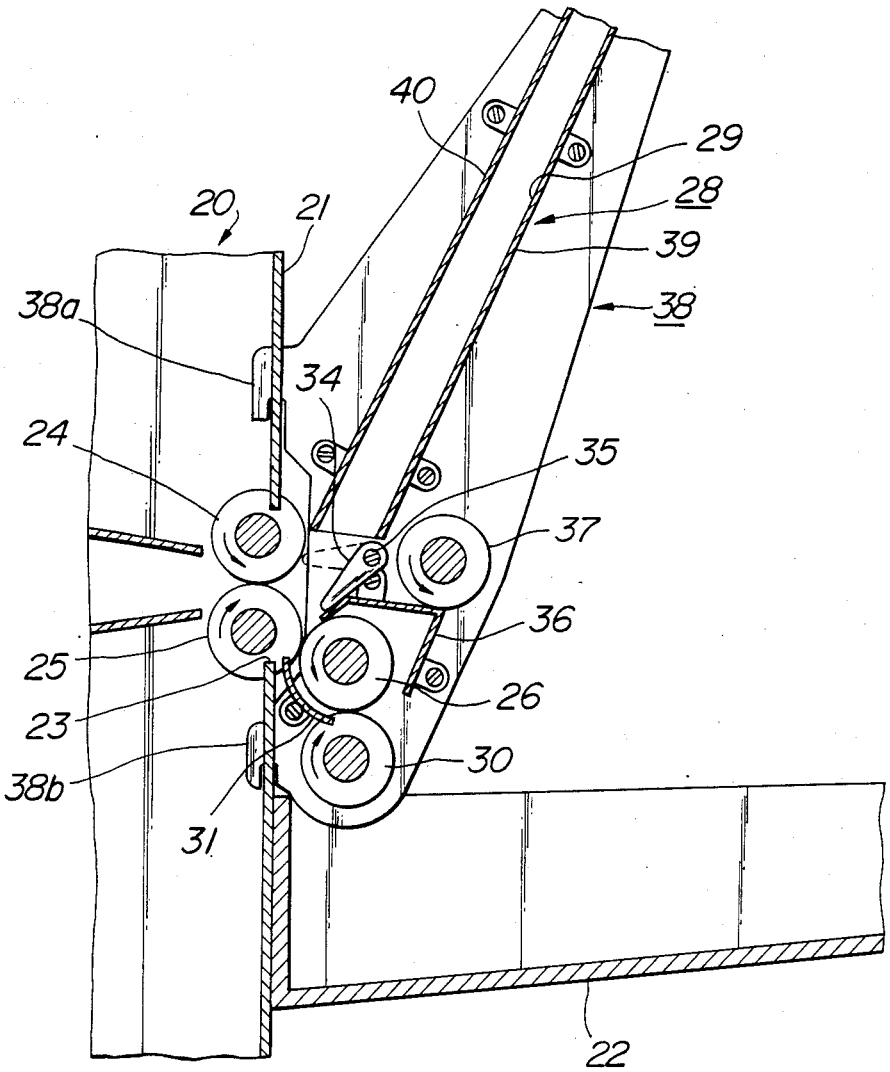
FIG. 6 is a cross sectional view showing still another embodiment of the sheet turn over apparatus according to the invention, which is applied to an existing copying machine.

FIG. 6 is a cross sectional view showing still another embodiment of the sheet turn over apparatus according to the invention, which is constructed as an optional device. In the present embodiment, all the components shown in FIG. 5 except for the first and second rollers 24 and 25 are united as shown to construct an optional device 38. When the optional device 38 is secured detachably to an image forming apparatus 20 comprising at a sheet outlet 23, a pair of sheet discharging rollers 24 and 25 serve as the first and second rollers 24 and 25 of the apparatus shown in FIG. 5.

As illustrated in FIG. 6, plates 39 and 40 form an inclined surface 29 and a surface opposite to the surface 29, third and fourth rollers 26 and 30, third sheet guide member 36 and resilient roller 37 are supported by a pair of side frames, and hook portions 38*a* and 38*b* of the side frames are engaged with slits formed in a side plate 21 of the image forming apparatus 20. Then, the third roller 26 of the optional device 38 is urged against the second roller 25 provided at the sheet discharging outlet 23 formed in the side plate 21 of the image forming apparatus 20.

The operations of the embodiment shown in FIG. 6 in the turn over mode and non-turn over mode are the same as those of the embodiment illustrated in FIG. 5 and thus are not explained.

In the case of applying the optional device 38 to the image forming apparatus 20 so as to utilize the sheet discharging rollers 24, 25 as the first and second rollers of the sheet turn over apparatus according to the invention, it is possible to transfer the rotational force for rotating the rollers 26 and 30 in the optional device 38 by means of a frictional engagement between the second roller 25 and third roller 26. However, it is much more preferable to provide in the image forming apparatus 20 a driving end and also provide in the optional device 38 a driven end which is coupled with the roller 26 and is engaged with said driving end when the optional device 38 is secured to the image forming apparatus 20. For instance, a driving gear is secured to a shaft of the second roller 25 provided in the image forming apparatus 20 and a driven gear is fixed to a shaft of the third roller 26 provided in the optional device 38. When the optional device 38 is secured to the image forming apparatus 20, the driven gear is engaged with the driving gear so as to rotate the third roller 26 via the driving and driven gears. Further the resilient roller 37 may be rotated by transferring thereto the rotational force of the third roller 26 by means of a suitable driving force transferring means.

Similarly, the control for the movable first sheet guide member 34 of the optional device 38 is not limited to the manual mode, but may be performed by a suitable electric-mechanical transducer. In such a case, an electric connector means may be automatically connected or disconnected by securing or detaching the optional device 38 to or from the image forming apparatus 20. Then the operational modes of the sheet turn over device may be effected by operating a mode selection switch provided on an operational panel of the image forming apparatus 20.

It should be noted that the detachably secured mechanism of the optional device 38 to the image forming apparatus 20 is not limited to the embodiment shown in FIG. 6, but may be formed in various ways. For instance, in order to simplify the removal of a jammed sheet or to simplify the engagement of the driving force coupling means, one edge of the optional device 38 may be hinged to the image forming apparatus. Then, the optional device may be opened like a clam-shell.

As explained above, the sheet turn over apparatus according to the invention can be simply and effectively applied to any existing image forming apparatus in which a pair of sheet discharging rollers are arranged at the sheet outlet.

In the embodiment illustrated in FIG. 6, the optional device including all the components of the sheet turn over apparatus according to the invention except for the first and second rollers 24 and 25. However, all the components including the first and second rollers may be formed as an optional device, and the optional device may be detachably secured to the image forming apparatus in such a manner that a sheet which is discharged substantially horizontally from the image forming apparatus is introduced into the nip portion between the first and second rollers 24 and 25.

It should be further noted that the embodiments shown in FIGS. 3, 4 and 5 may also be formed as an optional device which may be detachably secured to the image forming device.

In the embodiments illustrated in FIGS. 4 to 6, sheets are discharged into the same tray both in the turn over mode and in the non-turn over mode. By using the sheet turn over apparatus of such embodiments, in the case of forming a plurality of recorded sheets only the first sheet is discharged in the non-turn over mode, and the remaining sheets are discharged in the turn over mode. Then, on the tray there is formed a stack of sheets in which only the first sheet is turned upside-down with respect to the remaining sheets. Therefore, by turning the first sheet it is possible to obtain a stack of sheets which are arranged in order. In this case, since the first sheet is discharged on the tray while its recorded surface faces upward, a user can confirm the condition of the image by monitoring the first sheet discharged on the tray. Further, by using the above sheet turning over apparatus it is also possible to effect a so-called sorting in which a plurality of sets each consisting of a plurality of sheets are discharged on the tray in such a manner that in each set, only the first sheets are reversed with respect to the remaining sheets.

In order to control the operation modes in the above explained manner, it is possible to operate manually a mode selection switch provided on an operation panel to drive the first sheet guide member 34 between the first and second positions. In a preferable embodiment, the third sheet guide member is automatically driven in such a manner that only the first sheet is not turned over, but the remaining sheets are all turned over. Such an automatic control for the first sheet guide member may be advantageously combined with an automatic document feeder. In such a case, when it is detected that original documents are set in the feeder, a predetermined sequence of control steps is performed to effect the turn over and non-turn over modes in a desired sequence in conjunction with a duplicating operation of the copying machine.

Now, the sheet orientation apparatus according to the invention using the sheet turn over apparatus explained above will be explained in detail.

Figure 7A:
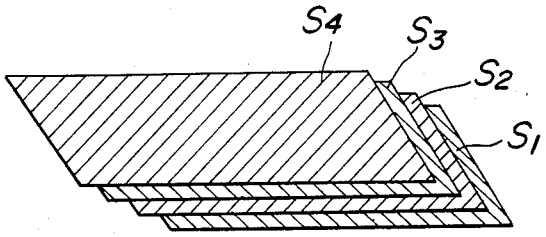
FIG. 7A is a schematic view depicting the typical condition of sheets discharged from a known copying machine.

FIGS. 7A to 7D are schematic views showing situations of discharged sheets. FIG. 7A represents a typical condition of sheets discharged by known copying machines. All sheets $S_1$ to $S_4$ are discharged while recorded surfaces face upward. On a first sheet $S_1$ is discharged a second sheet $S_2$, a third sheet $S_3$ is piled on the second sheet $S_2$, and so on. Therefore, in a stack of discharged sheets, the last sheet $S_4$ is placed in an uppermost position. Thus, when the original documents are duplicated in a normal order, the recorded sheets $S_1$ to $S_4$ are stacked in a reverse order. Therefore, after completion of duplication, the order of the discharged sheets must be inverted. However, since all the copies are discharged with their recorded surfaces facing upward, it is very convenient for confirming the condition of the recorded images.

Figure 7B:
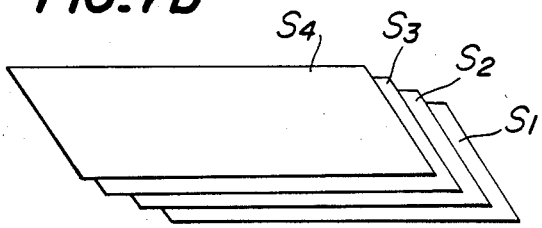
FIG. 7B is a schematic view illustrating the condition of sheets discharged on a bin of a sorter provided in a known copying machine.

FIG. 7B shows a situation of recorded sheets discharged on a bin of a known sorter coupled with a copying machine. In this case, all copies $S_1$ to $S_4$ are turned over and are stacked one upon another, while their recorded surfaces face downward. In this case, it is possible to obtain a stack of sheets which are arranged in a normal order. However, in general, the sorter is very complicated in construction, large in size and expensive in cost. Further, during the image formation, it is impossible to confirm the condition of the recorded images.

Figure 7C:
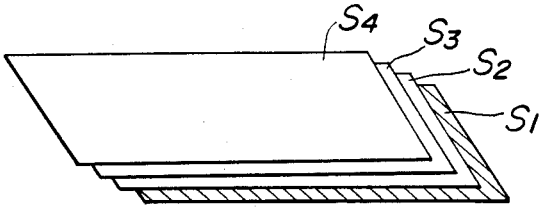
FIGS. 7C and 7D are schematic views showing sheets discharged from the sheet orientation apparatus according to the invention.

FIG. 7C is a schematic view showing a situation of sheets discharged by the sheet orientation apparatus according to the invention. In FIG. 7C, sheets $S_1$ to $S_4$ are a series of image recorded sheets which constitute a single set. Only a first sheet $S_1$ is not turned over and is discharged on the tray while its recorded surface faces upward. The remaining sheets $S_2$ to $S_4$ are turned over and are stacked on the first sheet $S_1$ successively while their image recorded surfaces face downward. Therefore, the condition of the image can be easily checked by monitoring the image formed on the first sheet $S_1$. Further, by simply turning over only the first copy $S_1$, all the sheets $S_1$ to $S_4$ in the stack are arranged in a normal order.

Figure 7D:
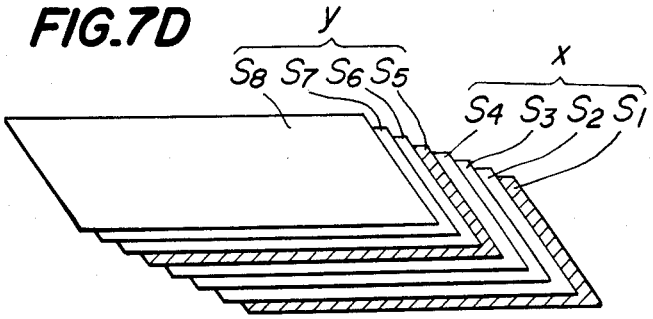

FIG. 7D represents another example of the situation of sheets discharged by the collating apparatus according to the invention. There are stacked two sets x and y of sheets, the set x containing four sheets $S_1$ to $S_4$ and the set y including four sheets $S_5$ to $S_8$. Contents of these sets x and y may be or may not be identical with each other. A first sheet $S_1$ in the first set x and a first sheet $S_5$ in the second set y are not turned over and are discharged on the tray while thier recorded surfaces face upward. The remaining sheets in the sets x and y are all turned over. Therefore, when a stack of sheets discharged on the tray is separated into the sets x and y at the non-turned over sheet $S_5$ and only the first sheets $S_1$ and $S_5$ in each sets are turned over, it is possible to obtain two sets of sheets separately, in each set all the sheets being arranged in a normal order. As will be explained later, according to the invention it is possible to arrange the sheets shown in FIG. 7D by means of a very simple mechanism. That is to say, according to the invention, the first sheet guide member 34 of the sheet turn over apparatus shown in FIGS. 4, 5 or 6 is so controlled that the operational modes are changed to obtain the sheet stacks illustrated in FIGS. 7C and 7D.

Figure 8:
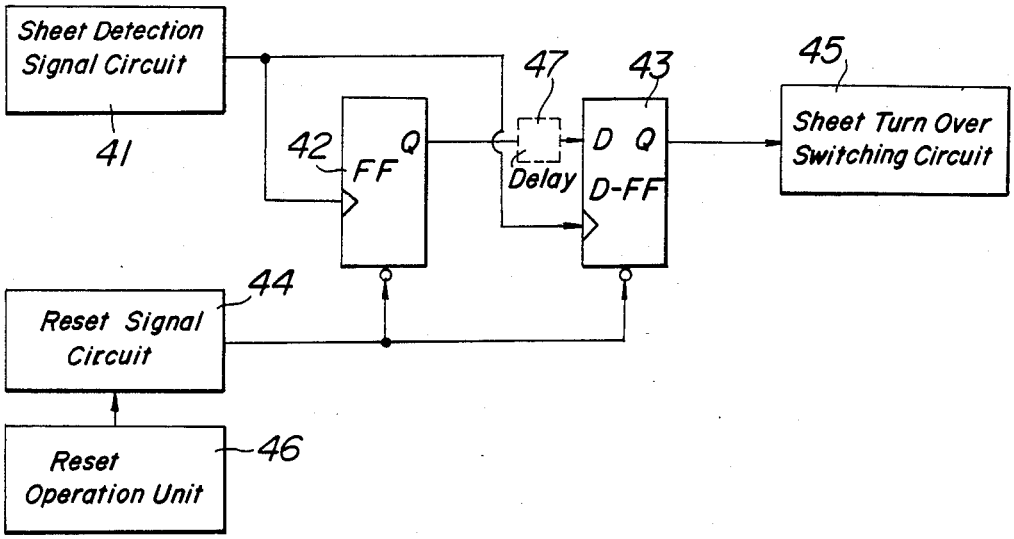
FIG. 8 is a block diagram illustrating an embodiment of a control circuit for changing the sheet discharge mode provided in the sheet orientation apparatus according to the invention.

FIG. 8 is a block diagram showing an embodiment of a control circuit for driving the movable first sheet guide member 34 shown in FIG. 6. A reference numeral 41 denotes a sheet detection signal circuit including a sheet detector and generating a sheet detection signal by shaping a waveform of an output signal of the sheet detector. The sheet detector is arranged near the nip portion between the first and second rollers 24 and 25 arranged in the image forming apparatus 20 so as to detect a sheet which is going to be supplied into the sheet turn over apparatus. The sheet detection signal circuit 41 is connected to an RS flip-flop circuit 42 and a D flip-flop circuit 43, these flip-flop circuits 42 and 43 being set by the sheet detection signal supplied from the sheet detection signal circuit 41 as a clock signal and being reset by a reset signal supplied from a reset signal circuit 44. To the D input terminal of the D flip-flop circuit 43 is connected the Q output terminal of the RS flip-flop circuit 42. The Q output terminal of the D flip-flop circuit 43 is connected to a sheet turn over switching circuit 45 which controls the supply of an electric current to a solenoid for driving the first sheet guide member 34. That is to say, the sheet turn over switching circuit 45 is a circuit for driving the solenoid which is coupled with the shaft 35 of the first sheet guide member 34.

The reset signal circuit 44 is so constructed that it produces a reset signal in response to a signal supplied from a reset operation unit 46. That is to say, when the reset signal circuit 44 receives the signal from the reset operation unit 46, the reset signal circuit 44 supplies the reset signal at a timing related to said signal to the flip-flop circuits 42 and 43.

When recorded sheets are successively fed by the first and second rollers 24 and 25, the sheet detection signal circuit 41 generates sheet detection signals which are supplied to clock terminals of the flip-flop circuits 42 and 43. When a first sheet detection signal is generated in response to the detection of the first sheet, the RS flip-flop circuit 42 is set and its Q output is changed to "1". However, when the first sheet detection signal is applied to the clock terminal of the D flip-flop circuit 43, the Q output of the RS flip-flop circuit 43 has not yet been changed to "1". Therefore, the D flip-flop circuit 43 remains in a reset state and thus its Q output is not changed. Therefore, the sheet turn over switching circuit 45 is not actuated, and thus the first sheet guide member 34 remains in the second position shown by the broken line in FIG. 6. Therefore, the first sheet is discharged on the tray 22 without being turned over, while its recorded surface faces upward.

Next a second sheet is detected, and a second sheet detection signal is generated by the sheet detection signal circuit 41 and is supplied to the flip-flop circuits 42 and 43. Since the RS flip-flop circuit 42 has been set by the first sheet detection signal, its Q output remains "1". However, since the Q output of "1" from the flip-flop circuit 42 has been applied to the D input terminal of the D flip-flop circuit 43, the Q output of this flip-flop circuit 43 is changed from "0" to "1" in response to the second sheet detection signal. Then, the sheet turn over switching circuit 45 is operated and the first sheet guide member 34 is driven into the first position shown by the solid line in FIG. 6. Therefore, the second sheet is diverted by the first sheet guide 34 into the sheet support member 28 and then is fed in a reverse direction. In this manner, the second sheet is turned over and is discharged on the first sheet, while its recorded surface faces downward.

This turn over mode of operation will last until the flip-flop circuits 42 and 43 are reset by the reset signal supplied from the reset signal circuit 44.

In the manner explained above, the first sheet is not turned over, but the remaining sheets are all turned over to form a stack of sheets on the tray 22 as illustrated in FIG. 7C. In order to operate the flip-flop circuits 42 and 43 at correct timings, there may be inserted a delay circuit 47 between the Q output terminal of the first flip-flop circuit 42 and the D input of the second flip-flop circuit 43, as illustrated by a broken line in FIG. 8.

In order to return the operating mode of the sheet turn over apparatus into the initial non-turn over mode, the reset signal circuit 44 is driven by the control signal from the reset operation unit 46 to produce the reset signal. That is to say, after a series of sheets have been discharged on the tray 22, when the reset signal is supplied from the reset signal circuit 44 to the flip-flop circuits 42 and 43, these flip-flop circuits are reset and their Q outputs are changed to "0". Then, the sheet turn over switching circuit 45 is deenergized and the first sheet guide 34 returned returns to the second position to prepare for the next operation. In this manner, when a series of sheets are supplied to the sheet orientation apparatus according to the invention while their recorded surfaces face upward, only the first sheet is discharged as it is, while the remaining sheets are all turned over. Therefore, the sheets are stacked on the tray 22 as shown in FIG. 7C, and thus by simply turning over the first sheet manually, it is possible to obtain a stack of sheets which are arranged in a normal order. Further, by actuating the reset operation unit 46 to produce one or more reset signals from the reset signal circuit 44 during the formation of a plurality of sheets, it is possible to change the operation mode into the non-turn over mode so that one or more sheets which are fed from the image forming apparatus immediately after the actuation of the reset operation unit 46 may be discharged on the tray with their recorded surfaces facing upward. In this manner, a plurality sets of sheets which are separated by non-turned over sheets can be piled on the tray 22 as illustrated in FIG. 7D.

In the control circuit shown in FIG. 8, the reset operation unit 46 may be formed in various forms in accordance with the image forming apparatuses to which the sheet orientation apparatus according to the invention is applied.

Figure 9:
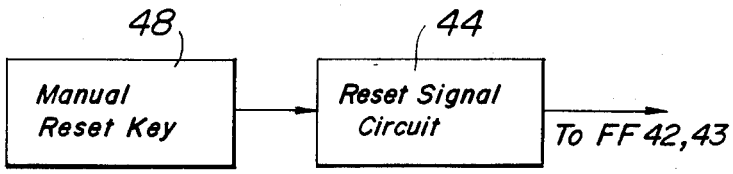
FIGS. 9, 10 and 11 are block diagrams showing three embodiments of a reset operating unit for controlling a reset signal circuit shown in FIG. 8.

FIG. 9 is a block diagram showing an embodiment of the reset operation unit 46. In the present embodiment, the reset operation unit is formed by a manual reset key 48 provided on the operation panel. When the manual reset key 48 is actuated, the reset signal circuit 44 is triggered to produce the reset signal. Therefore, during the formation of a number of recorded sheets, any desired sheets may be discharged in the non-turn over mode by operating the manual reset key 48. For instance, when a number of sheets are to be stacked as a single set, it is not necessary to actuate the manual reset key 48. Then, only the first sheet is discharged in the non-turn over mode and succeeding sheets are all discharged in the turn over mode. In the case of forming a plurality of sets of sheets, every time a set of sheets has been discharged said manual reset key 48 is actuated so as to discharge the first sheets in each set in the non-turn over mode. In this manner, the condition of the recorded image can be easily confirmed by the first sheets in each set. Further, a plurality of sets can be simply separated from each other at the first sheets. Moreover, in each set by merely turning over the first sheet, it is possible to obtain a stack of sheets arranged in a normal order.

In the present embodiment, if the manual reset key 48 is actuated prior to an instant when the last sheet in each set is detected by the sheet detector provided in the sheet detection signal circuit 41, the last sheet is erroneously discharged in the non-turn over mode. In order to avoid such a malfunction, it is preferable to arrange in the reset signal circuit 44 means for delaying the timing of the reset signal.

Figure 10:
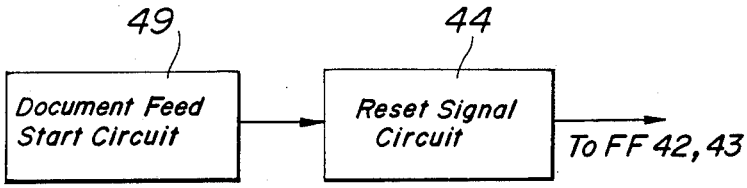

FIG. 10 is a block diagram showing another embodiment of the reset operation unit 46. The present embodiment is particularly preferable when the sheet orientation apparatus according to the invention is applied to a copying machine comprising an automatic document feeder (hereinafter abbreviated as ADF). The reset operation unit is composed of a document feed start signal generating circuit 49 of the ADF. In general, the document feed start signal generating circuit 49 is so constructed that when documents to be duplicated are set in the ADF and a copy start key is actuated, the circuit 49 generated a document feed start signal. To this end, the document feed start signal is obtained by a logic product (AND) of a sheet detection signal which is generated by a sheet detector for detecting the existence of the documents on a document table of the ADF, and a print start signal generated in response to the actuation of the print start key. In the present embodiment, the document feed start signal generated from the document feed start signal generating circuit 49 is supplied to the reset signal circuit 44 and the reset signal is generated at a suitable timing such that each time documents are placed on the document table of the ADF, the flip-flop circuits 42 and 43 shown in FIG. 8 are automatically reset.

In the present embodiment, the ADF itself is automatically controlled by a control signal which is generated in response to the start signal produced from the document feed start signal generating circuit 49, and is retained until the documents set on the document table are all discharged.

In the present embodiment, when the documents are set on the document table of the ADF and the print start key is actuated, the duplication is initiated, and at the same time the reset signal circuit 44 is operated to reset the flip-flop circuits 42 and 43 into the initial state. Therefore, a first duplicated sheet corresponding to a first document in the document stack is discharged on the tray with its image surface facing upward, and then succeeding duplicated sheets are discharged on the first sheet in the turn over mode. After all the documents on the document table of the ADF have been fed, when a new stack of documents is set on the document table and the copy start key is actuated again, the above explained operation is repeated. In this manner, according to the present embodiment, by merely setting plural sets of documents successively on the document table of the ADF, plural sets of recorded sheets are discharged on the tray 22 in such a manner that in each set only the first sheet is not turned over.

Immediately, after the last document in the set has been completely fed, when a new set of documents is placed on the document table and the copy start key is actuated, if the first sheet corresponding to the first document of the new set is detected by the sheet detector before the last sheet corresponding to the last document of the last set has passed through the first and second sheet guide members 34 and 31, there might occur malfunction and sheets might be jammed. In order to positively avoid the above mentioned drawback, there may be provided in the reset signal circuit 44 a delay circuit for delaying the timing of the reset signal until such an instant that the last sheet has completely passed through the sheet guide members 34 and 31.

Figure 11:
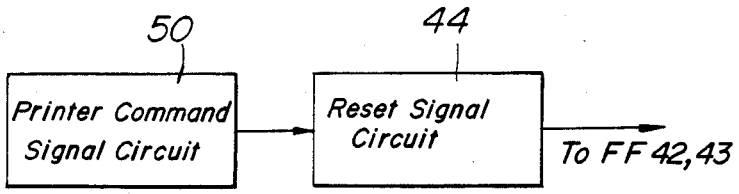

In the case of applying the sheet oreintation apparatus according to the invention to an image forming apparatus, such as a printer, in which image information for forming a hard copy is supplied in the form of an electric signal and the operation of the apparatus is commanded by a host apparatus, it is preferable to control the reset signal circuit 44 on the basis of a control signal supplied from the host apparatus to the printer. FIG. 11 is a block diagram showing such an embodiment. In this embodiment, the reset operation unit is formed by a printer command signal circuit 50 which includes a control signal generating circuit for controlling the reset signal circuit 44. The reset signal circuit 44 is triggered by a control signal supplied from the circuit 50 to produce the reset signal.

As is well known, the printer is not directly controlled by an operator, but is actuated by the control signal transmitted at the electric signal. Therefore, in the present embodiment, the printer command signal circuit 50 generates the reset signal circuit control signal in synchronism with the printer command signal, by means of which the printer is operated as usual and a picture signal corresponding to a plurality of recorded images is supplied to the printer. At the same time, the reset signal circuit control signal is supplied to the printer together with the printer command signal. The reset signal circuit control signal is supplied to the set signal circuit 44 after the picture signal of a series of images has been transmitted, but prior to the transmission of a picture signal of a next series of images, or simultaneously with the printer command signal.

Also in the present embodiment, similarly to the embodiment shown in FIG. 10, plural sets of recorded sheets which are successively supplied from the printer controlled by the host apparatus are stacked on the tray in such a manner that recorded surfaces of only first sheets in each set are reversed with respect to the remaining sheets.

In the present embodiment, if there might occur a malfunction due to the fact that the reset signal is generated at too fast a timing, a delay circuit may be provided in the reset signal circuit 44 or the generation timing of the control signal from the control signal generation circuit in the printer command signal circuit 50 may be delayed by a suitable time to ensure the correct operation of the sheet orientation apparatus according to the invention.

Figure 12:
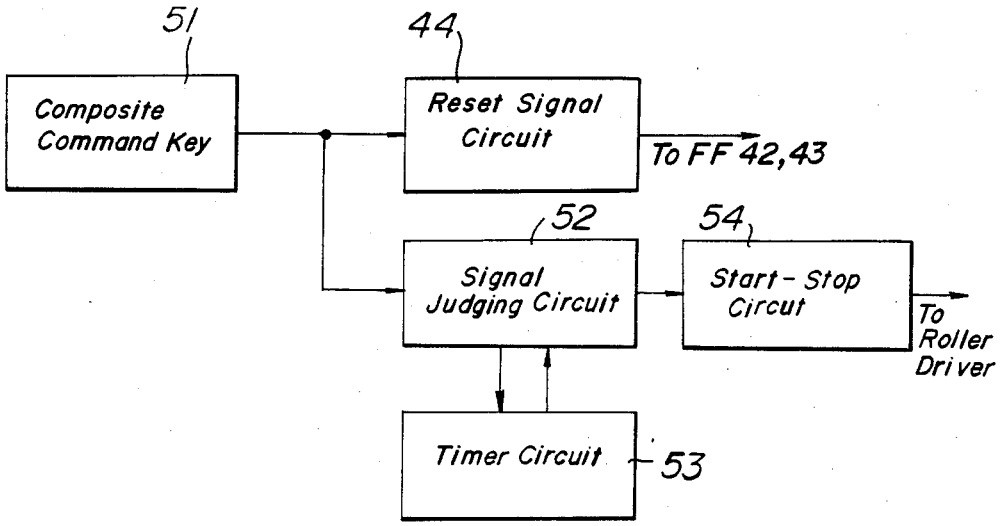
FIG. 12 is a block diagram showing another embodiment of the control circuit provided in the sheet orientation apparatus according to the invention.

FIG. 12 is a block diagram showing another embodiment of the control circuit of the sheet orientation apparatus according to the invention. In the present embodiment, the manual reset key 48 shown in FIG. 9 is modified into a composite command key 51 which has a reset command function as well as a command function for driving the rollers of the collating apparatus according to the invention. That is to say, the composite command key 51 generates signals having durations corresponding to key actuation times, and the reset command and the roller control command are selectively performed in dependence upon the durations of the signals. By utilizing such a composite command key 51, it is possible to reduce the number of operation keys and make the operation panel simpler.

The signal generated from the composite command key 51 is supplied to a reset signal circuit 44 and a signal judging circuit 52 which judges the length of the received signal. The reset signal circuit 44 generates a reset signal in response to, for instance, a front edge of the input signal, and the reset signal thus generated is supplied to the reset terminals of the flip-flop circuits 42 and 43 shown in FIG. 8 to reset these circuits 42 and 43.

The signal judging circuit 52 generates an output signal when the input signal lasts for more than a predetermined time. In this embodiment, there is provided a timer circuit 53 which is triggered by the signal supplied from the composite command signal. The signal judging circuit 52 includes a T flip-flop circuit, which is driven by a logical product signal (AND) of a timer signal generated by the timer circuit 53 after said predetermined time period has elapsed and the signal generated by the composite command key 51. The T flip-flop circuit is reset by a similar AND signal which is derived by actuating again the composite command key 51 for a long time. Therefore, the signal judging circuit 52 produces an output signal which increases when the composite command key 51 has been actuated for more than said predetermined time period and will last until the composite command key 51 will be actuated again for a time longer than the predetermined time period. The output thus generated is supplied to a start-stop circuit 54 for switching on and off a driving power supply circuit for the rollers of the collating apparatus. The start-stop circuit 54 may control the power supply to the sheet orientation apparatus according to the invention.

When the composite command key 51 is actuated for a shorter time period, the flip-flop circuits 42 and 43 are reset. Therefore, only a sheet which is discharged immediately after the composite command key 51 has been driven for a shorter period is discharged in the non-turn over mode, whereas the remaining sheets are discharged in the turn over mode. On the other hand, when the composite command key 51 is actuated for a longer time than the predetermined time set in the timer circuit 53, the sheet orientation apparatus can be operated until the composite command key 51 is actuated again for a longer time than the predetermined time.

In the case of applying the present invention to an image recording apparatus, it is preferable to set the operation mode of the sheet orientation apparatus in such a manner that when the composite command key 51 is not actuated, a sheet is discharged on the tray, while its recorded surface faces upward. That is to say, in the embodiment shown in FIG. 6, the movable first sheet guide member 34 is set in the second position illustrated by a broken line.

As explained above in detail, in the sheet orientation apparatus according to the invention, only the first sheet among a series of sheets can be discharged on the tray with their recorded surfaces facing upward, while the remaining sheets are turned over. Therefore, the operator can easily confirm the condition of the recorded images by simply monitoring the first sheet. Further, in the case of forming a plurality of sets, these sets can be easily and positively separated from each other at first sheets of respective sets. Moreover, after separating the sets, by simply turning over the first sheet, it is possible to obtain a stack of sheets which are arranged in a normal order.

Further, since the operating mode of the sheet orientation apparatus can be manually switched at any desired instant between the non-turn over mode and the turn over mode, in the case of forming a number of sheets which are not to be sorted, recording condition of any desired one or more sheets can be monitored at will. Moreover, in order to count the number of discharged sheets, the operating mode may be changed each time a predetermined number of sheets are discharged. Further, in the case of applying the sheet orientation apparatus according to the invention to a copying machine with an automatic document feeder or to a printer which is controlled by the host apparatus, the operating mode can be automatically changed by the control signal which is superimposed on the copy start signal supplied from the automatic document feeder or on the printer command signal supplied from the host apparatus. Then, the sorting function as well as the sheet orientation function can be performed automatically.

Moreover, in the embodiment shown in FIG. 12, the composite command key 51 performs both the function of the reset operation unit 46 illustrated in FIG. 8 and the function of the start and stop switch for the sheet feed mechanism of the sheet orientation apparatus. Therefore, the construction of the operation panel can be simplified.

Further, in the sheet turning over apparatus according to the invention, since the vertical height of the apparatus can be made smaller than the known apparatuses, the apparatus can be advantageously applied to an image forming apparatus such as a desk top type copying machine in which recorded sheets are discharged from the outlet provided near the bottom of the apparatus.

The various advantages of the apparatus according to the invention may be summarized as follows.

(1) Since the second nip portion between the second and third rollers is arranged substantially laterally with respect to the first nip portion between the first and second rollers, and the third nip portion between the third and fourth rollers is arranged substantially vertically with respect to the second nip portion between the second and third rollers, the angle over the second and third nip portions can be made smaller, and further the length of the curved second sheet guide arranged between the second and third nip portions can be also made shorter. Therefore, the possibility of a jam between the second and third nip portions can be reduced materially.

(2) In the case of constructing the apparatus to take selectively the non-turn over mode and the turn over mode, it is possible to discharge both turned over sheets and non-turned over sheets on the same tray. Therefore, not only can the discharged sheets be taken out easily, but also even thin sheets can be correctly aligned on the tray. Further, the condition of recorded images can be easily confirmed by monitoring the non-turned over sheets.

(3) The apparatus according to the invention can be easily constructed as an optional apparatus. When the optional apparatus is applied to an existing image forming apparatus, it is possible to provide the existing image forming apparatus with the sheet turning over function in a very economical manner.

(4) The construction of the apparatus is relatively simple, and thus the apparatus can work reliably for a long time without fault.

(5) By selectively driving the sheet turn over apparatus, discharged sheets can be arranged in a normal order and can be sorted into a plurality of sets. Further, the condition of recorded images can be confirmed by monitoring the first sheets in each set.

What is claimed is:

1. A sheet orientation apparatus comprising a sheet turn over switching mechanism for discharging a sheet selectively in a non-turn over mode and in a turn over mode;

a sheet discharging mechanism for discharging successive sheets on a tray to form a stack of sheets; and control means for driving said sheet turn over switching mechanism in such a manner that only the first sheet among a series of sheets is discharged on the tray while an image recorded surface of the first sheet faces in an opposite direction to that of the remaining sheets, wherein said sheet discharging mechanism comprises first and second rollers arranged vertically to form a first nip portion therebetween for feeding a sheet substantially horizontally, a third roller arranged substantially laterally with respect to the second roller to form a second nip portion between the second and third rollers, a fourth roller arranged below the third roller to form a nip portion between the third and fourth rollers, a sheet support member having an opening arranged above the third roller and an inclined surface for supporting a sheet fed through the opening, a first sheet guide member arranged movably between a first position in which the first sheet guide member is engaged with a sheet fed from the first nip portion guides the sheet onto the inclined surface through the opening of the sheet supporting member and a second position in which the first sheet guide member is not engaged with the sheet supplied from the first nip portion, and a second sheet guide member arranged between the second and third nip portions in such a manner that a sheet fed from the sheet support member by the second nip portion is guided into the third nip portion, and said sheet turn over switching mechanism includes means for driving selectively said first sheet guide member into the first and second positions.

2. An apparatus according to claim 1, wherein said first sheet guide member is positioned adjacent the opening of the sheet support means and is arranged movably between a first position in which the sheet guide member is engaged with a sheet fed from the first nip portion and a second position in which the first sheet guide member is not engaged with the sheet, and the apparatus further comprises control means for selectively driving the first sheet guide member into said first and second positions, whereby an operational mode of the apparatus can be changed between a turn over mode and a non-turn over mode.

3. An apparatus according to claim 2, further comprising a third sheet guide member arranged above the third roller for guiding a sheet fed substantially horizontally from the first nip portion in the non-turn over mode in which the first sheet guide member is in the second position.

4. An apparatus according to claim 3, further comprising a resilient roller arranged above the third sheet guide member for feeding a sheet between the third sheet guide member and the resilient roller.

5. An apparatus according to claim 1, wherein the third and fourth rollers, the sheet support member and the first and second sheet guide members are constructed as a unit which can be applied to an image forming apparatus having a pair of sheet discharging rollers in such a manner that the third roller is engaged with a lower sheet discharging roller of the image forming apparatus.

6. An apparatus according to claim 1, wherein said inclined surface of the sheet support member is inclined by about 30° with respect to a vertical direction.

7. An apparatus according to claim 1, wherein an upper end of the sheet support member is opened.

8. An apparatus according to claim 1, wherein a first line extending through the nip portion defined by the second and third rollers and perpendicular to a plane passing through the exes of the second and third rollers, and a second line extending through the nip portion defined by the third and fourth rollers and perpendicular to a plane passing through the axes of the third and fourth rollers, define an angle therebetween that ranges from about 60° to about 90° so that a sheet that passes sequentially through the respective nip portions is turned through an angle of from about 90° to about 120°.

9. An apparatus according to claim 1, wherein said first and second sheet guide members are positioned on the same side of a vertical plane that passes through the axes of the first and second rollers.

10. A sheet orientation apparatus comprising a sheet turn over switching mechanism for discharging a sheet selectively in a non-turn over mode and in a turn over mode;

a sheet discharging mechanism for discharging successive sheets on a tray to form a stack of sheets; and control means for driving said sheet turn over switching mechanism in such a manner that only the first sheet among a series of sheets is discharged on the tray while an image recorded surface of the first sheet faces in an opposite direction to that of the remaining sheets, wherein said control means is so constructed that an operational mode of the sheet turn over switching mechanism is changed only for the first sheet in a series of sheets in response to a manually generated command signal, and wherein said control means includes a composite command key and a circuit for judging an actuation time of the composite command key to generate said command signal and a control signal for driving the sheet discharging mechanism, whereby the composite command key has both an operational mode switching function for the sheet discharging mechanism and a function for starting and stopping the sheet discharging apparatus.

11. A sheet orientation apparatus comprising a sheet turn over switching mechanism for discharging a sheet selectively in a non-turn over mode and in a turn over mode;

a sheet discharging mechanism for discharging successive sheets on a tray to form a stack of sheets; and control means for driving said sheet turn over switching mechanism in such a manner that only the first sheet among a series of sheets is discharged on the tray while an image recorded surface of the first sheet faces in an opposite direction to that of the remaining sheets, wherein the apparatus is applied to an image forming apparatus having an automatic document feeder, and said control means for driving the sheet turn over switching means is controlled by a feed start signal supplied from the automatic document feeder in such a manner that the operational mode of the sheet discharging mechanism is switched into the non-turn over mode only for a first sheet among a plurality of sheets.

12. A sheet orientation apparatus comprising a sheet turn over switching mechanism for discharging a sheet selectively in a non-turn over mode and in a turn over mode;

a sheet discharging mechanism for discharging successive sheets on a tray to form a stack of sheets; and control means for driving said sheet turn over switching mechanism in such a manner that only the first sheet among a series of sheets is discharged on the tray while an image recorded surface of the first sheet faces in an opposite direction to that of the remaining sheets, wherein the apparatus is applied to a printer for forming hard copies in response to an image signal, and said control means for driving the sheet turn over switching mechanism is controlled by a control signal supplied from a host apparatus to the printer in such a manner that the operational mode of the sheet discharging apparatus is switched into the non-turn over mode only for a first sheet among a plurality of sheets.

13. A sheet orientation apparatus comprising a sheet turn over switching mechanism for discharging a sheet selectively in a non-turn over mode and in a turn over mode;

a sheet discharging mechanism for discharging successive sheets on a tray to form a stack of sheets, said sheet discharging mechanism including a sheet turn over apparatus having first and second rollers arranged substantially vertically to form a first nip portion therebetween for feeding a sheet substantially horizontally, a third roller arranged substantially laterally with respect to the second roller to form a second nilp portion between the second and third rollers, said second nip portion spaced horizontally outwardly of and vertically from said first nip portion, a fourth roller arranged substantially vertically below the third roller to form a third nip portion between the third and fourth rollers, said third nip portion spaced horizontally outwardly of an vertically from said second nip portion, a sheet support member having an opening arranged above the third roller and an inclined surface for supporting a sheet fed through the opening, a first sheet guide member arranged in such a position that the first sheet guide member is engaged with a sheet fed substantially horizontally from the first nip portion and the sheet is guided through the opening onto the inclined surface of the sheet support member, and a second sheet guide member arranged between the second and third nip portions in such a manner that a sheet fed from the sheet support member by the second nip portion is guided into the third nip portion; and control means for driving said sheet turn over switching mechanism in such a manner that only the first sheet among a series of sheets is discharged on the tray while an image recorded surface of the first sheet faces in an opposite direction to that of the remaining sheets.

* * * * *